United States Patent [19]

Spellman

[11] Patent Number: 4,575,895

[45] Date of Patent: Mar. 18, 1986

[54] REFUSE BAG FRAME FOR VACUUM CLEANERS

[76] Inventor: Stanley Spellman, 75 Cedar Dr., Roslyn, N.Y. 11576

[21] Appl. No.: 703,390

[22] Filed: Feb. 20, 1985

Related U.S. Application Data

[63] Continuation-in-part of Ser. No. 613,076, May 22, 1984, Pat. No. 4,531,258.

[51] Int. Cl.[4] ..... A47L 5/08

[52] U.S. Cl. ..... 15/327 R; 55/429; 55/DIG. 3; 248/99

[58] Field of Search ..... 15/327 R, 327 F; 55/379, 429, DIG. 2, DIG. 3; 248/95, 97, 99

[56] References Cited

U.S. PATENT DOCUMENTS

| | | | |
|---|---|---|---|
| 711,410 | 10/1902 | Means | 248/97 |
| 2,643,732 | 6/1953 | Keen | 55/379 X |
| 2,814,357 | 11/1957 | Bowman | 55/379 X |
| 3,740,933 | 6/1973 | Hollowell | 55/429 |
| 4,290,790 | 9/1981 | Okubo | 55/379 |

FOREIGN PATENT DOCUMENTS

| | | | |
|---|---|---|---|
| 0214500 | 4/1924 | United Kingdom | 248/99 |

*Primary Examiner*—Charles Hart
*Attorney, Agent, or Firm*—Collard, Roe & Galgano

[57] ABSTRACT

A refuse bag frame for supporting a refuse bag in a vacuum cleaner is provided. The vacuum cleaner has a cylindrical bin lined by the refuse bag and a cover thereover including a vacuum blower, the rim of the open end of the refuse bag is clamped between the rim of the cylindrical bin and the cover. The refuse bag frame includes at least one flat, band-like, horizontal hoop having a diameter no greater than the internal diameter of the cylindrical bin and a plurality of flat, spaced-apart, rigid, vertical supports connected to said at least one hoop and having lengths no greater than the internal height of said cylindrical bin so as to form a cylindrically-shaped frame dimensioned to fit within the refuse bag lining the cylindrical bin of the vacuum cleaner. Vertically spaced-apart pairs of laterally aligned slots are provided in each vertical support, each pair of slots being aligned with corresponding pairs of slots in the other vertical supports and said at least one horizontal hoop being connected to said vertical supports by being threaded through each slot of a pair of laterally aligned slots and said hoop being secured to said support thereat and being similarly connected to the remaining vertical supports at corresponding pairs of slots.

9 Claims, 5 Drawing Figures

REFUSE BAG FRAME FOR VACUUM CLEANERS

This is a continuation-in-part application of U.S. Ser. No. 613,076, filed May 22, 1984, and now U.S. Pat. No. 4,531,258 entitled "REFUSE BAG FRAME FOR VACUUM CLEANERS".

The present invention relates generally to a refuse bag frame for vacuum cleaners and, more particularly, it relates to a modification or variation of the refuse bag frame disclosed and claimed in my earlier filed application, identified above, the disclosure of which is herein incorporated by reference.

Vacuum cleaners, particularly of the industrial type, generally have a cylindrical bin to which is connected a pick-up hose and vacuum blower and which is mounted on wheels or rollers for movement. The vacuum blower which is mounted in the cover of the vacuum cleaner evacuates the cylindrical bin and the vacuum is directed through the pick-up hose so that the user is able to vacuum with this hose. Such vacuum cleaners generally come in two forms, the first wherein the pick-up hose is mounted in the side wall of the cylindrical bin of the vacuum cleaner removed from the bottom thereof so as to leave room for the debris in the cylindrical bin and wherein the pick-up hose is mounted in the vacuum cleaner lid. In both forms, the vacuum exhaust as well as the vacuum blower are mounted in the vacuum cleaner cover. Thus, whatever debris is picked up by the pick-up hose is deposited in the cylindrical bin of the vacuum cleaner and periodically, when the same is full, it must be emptied. Such emptying of the vacuum cleaner bin can be a messy operation since the bin must be physically lifted and inverted in order to dump the contents thereof.

By the utilization of a bag in the vacuum cleaner, it becomes unnecessary to dump the contents since, when the bag is full, it is discarded. Preferably, inexpensive plastic bags are utilized which also require a removable frame to maintain the bag's shape. In my earlier-filed application, I have disclosed a frame for a refuse bag for such a vacuum cleaner which consists of a plurality of vertically spaced-apart, horizontal hoops interconnected by a plurality of rigid, vertical supports and which basically corresponds to the shape of the cylindrical bin of the vacuum cleaner within which the refuse bag is utilized. Such a refuse bag frame may be formed with a plurality of rigid, elongated supports having a length great enough to accommodate a wide range of depths of different sized vacuum cleaners and a plurality of elongated flexible strips having lengths sufficient to form hoops to accommodate the diameters of a wide range of vacuum cleaners. The lengths of the elongated, flexible strips may be adjusted and formed by the user into hoops of the required diameter and connected horizontally in a vertically spaced-apart relationship by suitable fasteners to the elongated, rigid supports, the lengths of which may be easily adjusted to the required depth of the vacuum cleaner. Also, my prior application discloses that the elongated, rigid supports may be formed with angles, the lengths of the legs of which may be adjusted so that one leg of each support may be interconnected at its end to corresponding legs of the other supports in such a manner that the legs radiate from a central connection point thereby forming a base for the frame having a diameter corresponding to the diameter of the vacuum cleaner. As also disclosed in my prior application, the elongated, rigid supports may be U-shaped with the base of the U-shape corresponding to the diameter of the cylindrical bin of the vacuum cleaner so that several of such supports may be interconnected at the centers of their bases and the hoops formed from the elongated, flexible strips secured along the vertical legs of the supports to thereby form the refuse bag frame.

It is an object of the present invention to provide a frame for a refuse bag utilized in connection with a vacuum cleaner having a cylindrical bin which is a modification or variation of the refuse bag frame disclosed in my referenced prior-filed application which refines and improves the structure disclosed therein.

This object, as well as others which will hereinafter become apparent, is accomplished in accordance with the present invention by the provision of a frame for the refuse bag of a vacuum cleaner which is comprised of a plurality of vertically spaced-apart, horizontal hoops interconnected by a plurality of rigid, vertical supports which basically corresponds to the shape of the cylindrical bin of the vacuum cleaner within which the refuse bag is utilized. Each hoop is in the form of a thin, flat, elongated, band-like strip, the ends of which are connected together to form the hoop, the strip being passed or threaded through a pair of laterally aligned slots in each vertical support, the pairs of aligned slots in each vertical support being aligned with corresponding pairs of slots in the remaining vertical supports. The vertical supports are formed preferably of metal in thin, flat strips wherein a plurality of vertically spaced-apart, laterally aligned pairs of slots are formed to accommodate the thin, flat strips of the vertically spaced-apart hoops. Attachment means may also be provided at each hoop and vertical support interconnection. The vertical supports may be U-shaped with the base of the U having a length approximating the diameter of the circular bin of the vacuum cleaner with the individual U-shaped supports interconnected at the center of the base of the U.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
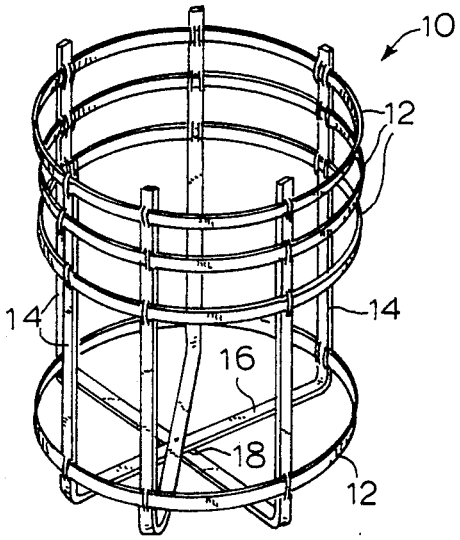
FIG. 1 is a perspective view of the refuse bag frame according to the present invention.

Now turning to the drawings, there is shown in FIG. 1 a refuse bag frame, generally designated 10, comprised of a plurality of vertically spaced-apart, horizontal hoops, designated 12, which are interconnected by spaced-apart, rigid, vertical supports, designated 14. Each hoop 12 is formed from an elongated, flat, band-like strip which is preferably sufficiently thin to permit flexibility and which may be made of any suitable material such as metal or plastic. The length of the elongated strip which forms hoop 12 is such that the hoop has a diameter corresponding to the diameter of the cylindrical bin of the vacuum cleaner with which frame 10 is to be utilized. The ends of the elongated strip may be fastened together by any suitable means such as welding or a fastener, etc. to form hoop 12.

Vertical rigid supports 14 may also be formed from flat and preferably thin, elongated strips which may have a U-shaped configuration having a base, designated 16, interconnecting two opposing vertical supports of frame 10. In the case where a plurality of such U-shaped vertical supports 14 are utilized, they may be pivotally interconnected at the center points of their bases 16, designated 18, by any suitable means such as a rivet, a nut and bolt, etc.

Figure 2:
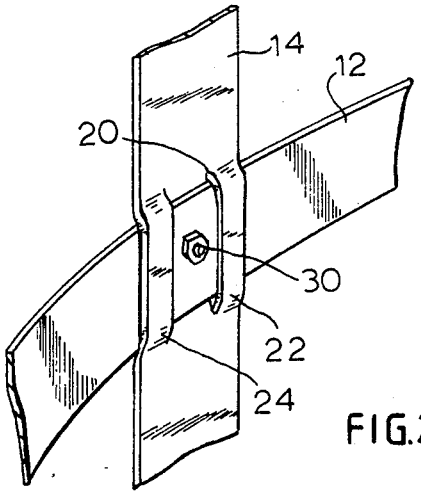
FIG. 2 is an enlarged perspective view of the interconnection between a vertical support and a horizontal hoop as viewed from the interior of the frame.
Figure 3:
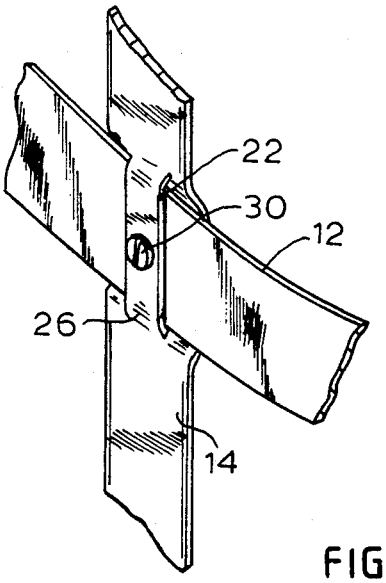
FIG. 3 is an enlarged perspective view of the interconnection between the vertical support and the horizontal hoop similar to that of FIG. 2 but viewed from the other direction thereof.

In FIGS. 2 and 3, the interconnection between hoop 12 and vertical support 14 is clearly shown. At this interconnection, vertical support 14 is provided with a pair of laterally aligned slots, designated 20 and 22, which forms three adjacent parallel segments, designated 24, 26 and 28, defined by slots 20 and 22. The elongated, band-like strip which forms hoop 12 is threaded through slots 20 and 22 so that segments 24 and 28 lie on one side of the band of hoop 12 while the central segment 26 lies on the other side of the band of hoop 12. Hoop 12 may then be fastened to vertical support 14 by suitable means such as nut and bolt 30 passing through one of the segments 24 to 28 and hoop 12. However, the dimensions of hoop 12 and slots 20 and 22 may be such that friction therebetween will be sufficient to secure or fasten the hoop to vertical support 14 without the need for mechanical fasteners. Each lateral support 14 is provided with a plurality of vertically spaced pairs of laterally aligned slots 20 and 22, each pair of which is aligned with corresponding pairs of slots in each of the other vertical supports 14.

The vacuum cleaners with which refuse bag frame 10 is utilized generally have their vacuum blower motor and vacuum exhaust located in the cover of the vacuum cleaner. Thus, as a general rule, the vacuum in the interior of the cylindrical bin of the vacuum cleaner is greatest near the cover therefor. Thus, in the case where a plastic bag is utilized as the refuse bag in a vacuum cleaner, the greater vacuum at the top of the vacuum cleaner has a tendency to draw the plastic bag towards the vacuum blower. If this tendency of the plastic bag to be drawn to the vacuum blower is not checked or prevented, the possibility exists that the plastic bag will come into contact with the blower and stifle the vacuum, thereby rendering the vacuum cleaner inoperative. In order to prevent this possibility, it is essential that sufficient support is provided to the plastic bag in the upper regions of the vacuum cleaner. Thus, as clearly seen in FIG. 1, several hoops 12 are employed at or near the upper extremity of refuse bag frame 10. In this manner, sufficient support is provided to the plastic bag to prevent its being drawn or sucked into the vacuum blower of the vacuum cleaner.

Figure 4:
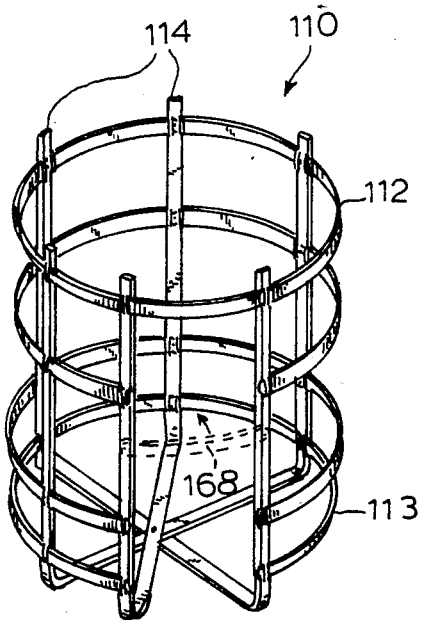
FIG. 4 is a perspective view of another embodiment of the refuse bag frame according to the present invention.
Figure 5:
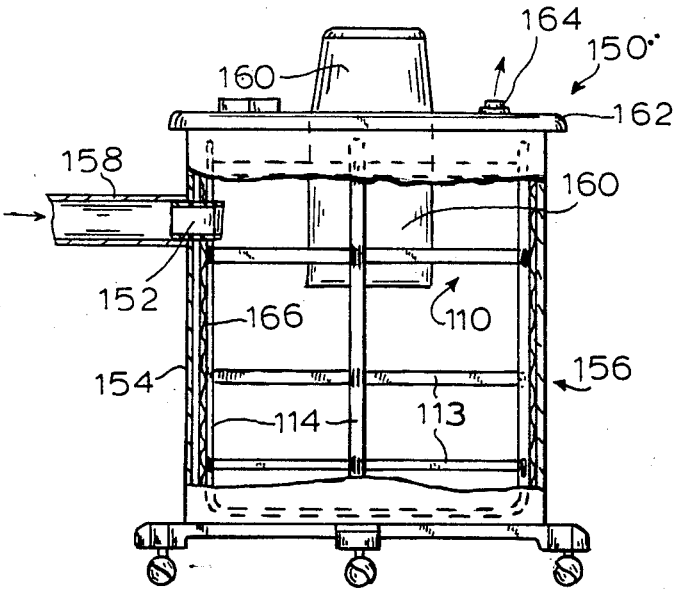
FIG. 5 is an elevational view of a vacuum cleaner, a part thereof being broken away, incorporating the refuse bag frame of the present invention.

In FIG. 4 there is shown another embodiment of the refuse bag frame of the present invention, generally designated 110. As clearly seen therein, the vertical supports 114 are essentially identical with vertical supports 14 of the embodiment of FIG. 1. Also, at least the uppermost horizontal support is provided by at least one hoop, designated 112, which is identical with the horizontal hoop 12 of the embodiment of FIG. 1. However, with respect to the lowermost horizontal supports, these are in the form of incomplete hoops, designated 113, wherein one segment of the hoop between a pair of adjacent vertical supports 114 is removed. Thus, refuse bag frame 110, as clearly seen in FIG. 5, is adapted to be utilized with a vacuum cleaner, generally designated 150, having its collection inlet nozzle 152 mounted in the sidewall 154 of the cylindrical bin 156 of the vacuum cleaner. The intake hose 158 is connected to nozzle 152 through which the refuse is sucked into the interior of bin 156 by means of the vacuum created by blower 160 mounted in cover 162. The vacuum is exhausted through exhaust nozzle 164 also located in cover 162. As clearly seen, collection inlet nozzle 152 is mounted in sidewall 154 and extends into the interior of cylindrical bin 156. Thus, it can be seen that if refuse bag frame 10 were inserted into bin 156 to support refuse bag 166 therein, the lower hoops 12 would prevent the passage therein because of the impediment resulting from nozzle 152. In such a situation, therefore, refuse bag frame 110 of FIG. 4 would be appropriate. Thus, the horizontally absent segments of hoops 113 would allow frame 110 to pass intake nozzle 152 unhindered so that the frame can be inserted into cylindrical bin 156 to support plastic bag 166. It should be noted that, depending on the vertical position of intake nozzle 152, more than one hoop 112 may be utilized in the upper regions of frame 110.

In order to ensure adequate structural stability to frame 110 in the lower regions thereof, an additional horizontal support, designated 168 and shown in phantom in FIG. 4, may be provided between the adjacent vertical supports 114 between which the hoop segments of hoops 113 have been removed. Support 168 may be in the form of a hoop segment which is pivotally mounted to one vertical support 114 and detachably connected to the adjacent vertical support 114. Thus, as frame 110 is inserted into cylindrical bin 156, support 168 may be detached at its one end and pivoted out of the way so that the frame can be inserted unimpeded by nozzle 152 into the bin. Once inserted, support 168 may be pivoted to the position shown in FIG. 4 and attached at its free end to vertical support 114. Of course, it is possible to use other support members in place of hoop segment 168 such as a coiled spring attached at each of its ends to adjacent vertical supports 114 which can be moved laterally out of the way when inserting frame 110 into the vacuum cleaner and then released after insertion.

While only two embodiments of the present invention have been shown and described, it will be obvious that many changes and modifications may be made thereto without departing from the spirit and scope of the present invention.

What is claimed is:

1. A refuse bag frame for supporting a refuse bag in a vaccum cleaner, said vacuum cleaner having a cylindrical bin lined by said refuse bag, a cover for the cylindrical bin including a vacuum blower, the rim of the open end of the refuse bag being clamped between the rim of the cylindrical bin and the cover, and a collection inlet extending through the sidewall of said cylindrical bin, said refuse bag frome comprising:

(a) at least one horizontal, band-like, flat hoop having a diameter substantially equal to the internal diameter of said cylindrical bin disposed at the upper region of said refuse bag frame above said collection inlet when said frame is mounted in said vacuum cleaner;

(b) at least one horizontal, band-like, flat, partial hoop having a diameter substantially equal to the internal diameter of said cylindrical bin disposed in the lower region of said refuse bag frame below the collection inlet in the side wall of said cylindrical bin;

(c) a plurality of flat, spaced-apart, rigid, vertical supports, each support having a length substantially equal to the internal height of said cylindrical bin and having vertically spaced-apart pairs of laterally aligned slots, each pair being aligned with corresponding pairs of slots in the other vertical supports, said at least one horizontal hoop being threaded through correspondingly aligned pairs of slots in the upper regions of said vertical supports, and said at least one horizontal, partial hoop being threaded through correspondingly aligned pairs of slots in the lower regions of said vertical supports below the collection inlet in the sidewall of said cylindrical bin when said refuse bag frame is inserted therein, said partial hoop interconnecting all but two adjacent vertical supports thereby resulting in a space therebetween, said space being aligned with said collection inlet in the sidewall of said cylindrical bin; and (d) means for securing said at least one hoop and said at least one partial hoop to said plurality of spaced-apart, vertical supports at the connections therebetween to form a cylindrically-shaped frame dimensioned to fit within the refuse bag lining the cylindrical bin of said vacuum cleaner.

2. The refuse bag frame as defined in claim 1, which further includes a horizontal support supporting the lower region of said refuse bag frame by detachably bridging between the adjacent vertical supports unsupported by said at least one partial horizontal hoop.

3. The refuse bag frame as defined in claim 1, wherein the material from which said vertical supports are formed is metal.

4. The refuse bag frame as defined in claim 1, wherein opposing pairs of said vertical supports are interconnected by a base leg which substantially matches the internal diameter of said cylindrical bin to form a U-shaped member, the base legs of said plurality of pairs of vertical supports being interconnected at their centers.

5. The refuse bag frame as defined in claim 1, wherein each pair of said pairs of aligned slots defines three adjacent segments in the vertical support and wherein said at least one hoop is threaded through said slots so that said three adjacent segments lie alternatingly on one side and the other of said flat, band-like hoop.

6. The refuse bag frame as defined in claim 1, wherein the means securing said at least one hoop and said at least one partial hoop to said vertical supports comprises a frictional engagement therebetween at the connection of said hoops to said vertical supports.

7. The refuse bag frame as defined in claim 1, wherein the means securing said at least one hoop and said at least one partial hoop to said vertical supports comprises mechanical fasteners.

8. The refuse bag frame as defined in claim 1, which further includes a horizontal support supporting the lower region of said refuse bag frame by bridging between the adjacent vertical supports unsupported by said at least one partial horizontal hoop, said horizontal support being pivotally connected to one of said adjacent upsupported vertical supports and detachably connected to the other adjacent unsupported vertical support.

9. The refuse bag frame as defined in claim 1, which further includes a horizontal support supporting the lower region of said refuse bag frame by bridging between the adjacent vertical supports unsupported by said at least one partial horizontal hoop, said horizontal support comprising a coiled spring the ends of which are mounted to said adjacent unsupported vertical supports.

* * * * *